US007437797B2

(12) United States Patent
Ptak et al.

(10) Patent No.: US 7,437,797 B2
(45) Date of Patent: Oct. 21, 2008

(54) DUSTER BRUSH ASSEMBLY FOR VACUUM CLEANERS

(75) Inventors: Patricia Kozlowski Ptak, 46160 Litchfield, Plymouth, MI (US) 48170; Victor Alfred Ptak, Plymouth, MI (US); Christopher Leo Ptak, Plymouth, MI (US)

(73) Assignee: Patricia Kozlowski Ptak, Plymouth, MI (US)

( * ) Notice: Subject to any disclaimer, the term of this patent is extended or adjusted under 35 U.S.C. 154(b) by 401 days.

(21) Appl. No.: 11/058,577

(22) Filed: Feb. 16, 2005

(65) Prior Publication Data

US 2006/0179607 A1 Aug. 17, 2006

(51) Int. Cl.
*A47L 5/00* (2006.01)

(52) U.S. Cl. ..... 15/398; 15/399; 15/400; 15/144.4; 15/184

(58) Field of Classification Search ..... None
See application file for complete search history.

(56) References Cited

U.S. PATENT DOCUMENTS

| | | | | |
|---|---|---|---|---|
| 1,604,918 | A * | 10/1926 | King | 15/184 |
| 4,972,541 | A * | 11/1990 | Smith, Jr. | 15/105 |
| 6,393,646 | B1 * | 5/2002 | Beers et al. | 15/144.4 |
| 6,799,350 | B1 * | 10/2004 | Gordon | 15/344 |

* cited by examiner

*Primary Examiner*—David A Redding

(57) ABSTRACT

The present invention relates to a duster brush assembly for a vacuum cleaner. The duster brush assembly includes a duster brush fixedly disposed at the air flow entrance of a hollow tubular member operatively connected to the vacuum cleaner. A hollow tubular member is telescopically mounted on a suction tube which is in communication with the vacuum cleaner. To clean the duster brush the hollow tubular member is moved forward over the duster brush is removed by vacuum into the vacuum cleaner.

6 Claims, 8 Drawing Sheets

DUSTER BRUSH ASSEMBLY FOR VACUUM CLEANERS

FIELD OF THE INVENTION

The present invention relates to a dust cleaning member for vacuum cleaners.

BACKGROUND OF THE INVENTION

Vacuum cleaners generally are either full-sized models or hand-held models. Generally all vacuum cleaners include a vacuum source, a power unit, and a cleaning nozzle with a cleaning orifice.

Various attachments, such as extension wands, crevice tools, upholstery tools and dust brushes adapted to mate with the cleaning orifices in order to provide more effective dirt and dust pick-up are known. The dust brush attachment tools pick up dirt and dust and need to be cleaned often to remove this dust and dirt. In order to clean presently available dust brush attachment tools it is necessary to remove these tools from the vacuum cleaner and insert them into the cleaning orifice. This is a cumbersome and time consuming process. It would be very advantageous and useful if a duster brush could be provided which did not have to be removed from the vacuum cleaner for cleaning but could be cleaned simply and easily while mounted on the vacuum cleaner. The present invention provides such a duster brush assembly.

SUMMARY OF THE INVENTION

The present invention relates to a duster brush assembly for a vacuum cleaner, which uses the suction power of the vacuum to which it is operatively connected to provide effective cleaning of dust and dirt particles. The present invention further relates to a duster brush assembly for a vacuum cleaner wherein the duster brush can be cleaned without having to be removed from the vacuum cleaner. The duster brush assembly comprises a suction tube in which the duster brush is fixedly mounted. A duster brush cleaning tube having a greater diameter than the suction tube is telescopically mounted over the suction tube. Duster brush cleaning tube can be slid over and encompasses the duster brush. When the duster brush cleaning tube is slid over the duster brush, the vacuum cleaner suction force sucks the dust and dirt particles from the duster brush thereby cleaning the duster brush. After the duster brush is cleaned, the duster brush cleaning tub is slid back over the suction tube thereby exposing the duster brush for dusting.

BRIEF DESCRIPTION OF THE DRAWINGS

These and other objects and advantages of the present invention will become apparent by reference to the following detailed description when considered in conjunction with the accompanying drawings.

DETAILED DESCRIPTION OF THE PREFERRED EMBODIMENTS

Figure 1:
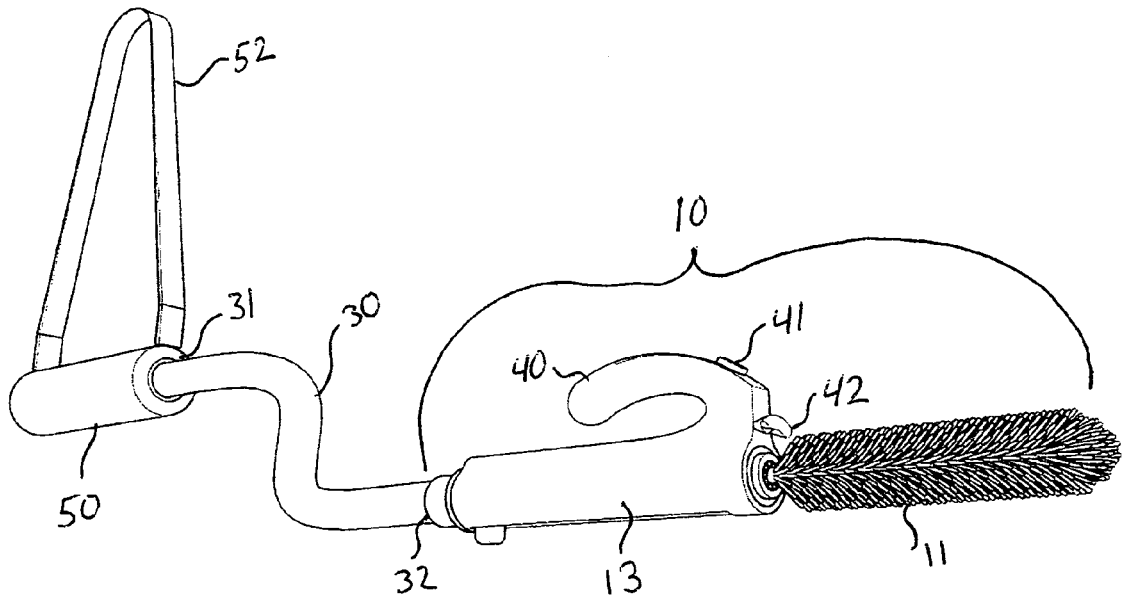
FIG. 1 is a perspective view of duster brush assembly attached to a vacuum cleaner.
Figure 2:
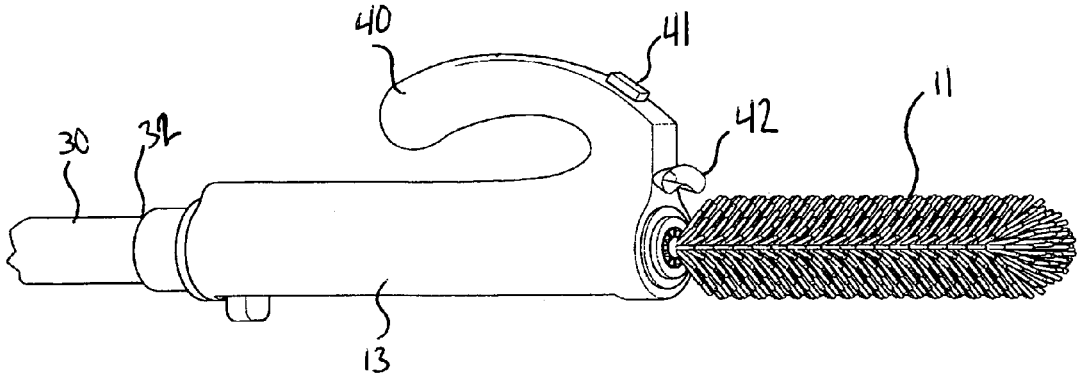
FIG. 2 is a perspective view of the duster brush assembly with the duster brush fully extended and ready for dusting.

As illustrated in FIG. 1 the duster brush assembly 10 is connected by a generally flexible suction hose 30 at one end 31 of the suction hose 30 to a vacuum cleaner 50. In the embodiment illustrated the vacuum cleaner is a well known light weight portable, hand held or shoulder carried model. This vacuum cleaner 50 is carried on a users shoulder by shoulder strap 52. It is to be understood that suction hose 30 can be connected at end 31 to any conventional and well known vacuum cleaner other then the hand held, shoulder carried model illustrated in FIG. 1.

In order to dust and clean a room the duster brush 11, is in the entirely uncovered or clear position as illustrated in FIGS. 1, 2, 5 and 8. For cleaning the duster brush 11, i.e. removing dust and dirt particles from duster brush 11 which said brush has picked up during the dusting process, duster brush cleaning tube 15 is extended, in the direction illustrated in FIGS. 4 and 9, over duster brush 11. The suction from the vacuum cleaner removes the dust and dirt particles from the duster brush 11.

Duster brush assembly 10 includes duster brush 11 and an outer casing 13. Duster brush 11 can be comprised of any of a variety of materials commonly used to make conventional and known duster brushes. These include, but are not limited to, animal or artificial feathers, cotton threads or bristles, vegetable fiber threads or bristles, or artificial fiber threads or bristles.

Figure 13:
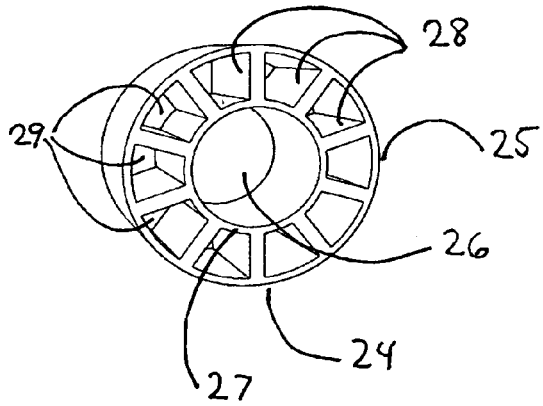
FIG. 13 is an enlarged front perspective view of the duster brush holding member.

Duster brush 11 is fixedly mounted in duster brush assembly 10. More particularly it is mounted in central annular chamber 26 in duster brush retaining member 24. Duster brush retaining member 24, as best illustrated in FIG. 13, is generally a ring shaped structure having an outer ring 25, an inner ring 27 which defines chamber 26 in which post 12 of duster brush 11 is mounted, and a plurality of radially extending vanes connecting outer ring 25 and inner ring 27. The post 12 of duster brush 11 can be affixed to chamber 26 by magnets, spring loaded pressure snap (similar to a standard vacuum house), pressure fitted, or by threads. The vanes 28 are spaced apart and define passages 29 which allow air and suction from the vacuum cleaner to pass through. Duster brush retaining member 24 is fixedly disposed in the interior of suction tube 20 which is in the interior of Casing 13.

Duster brush cleaning tube 15 is telescopically mounted over suction tube 20, and is also located in casing 13.

Figure 3:
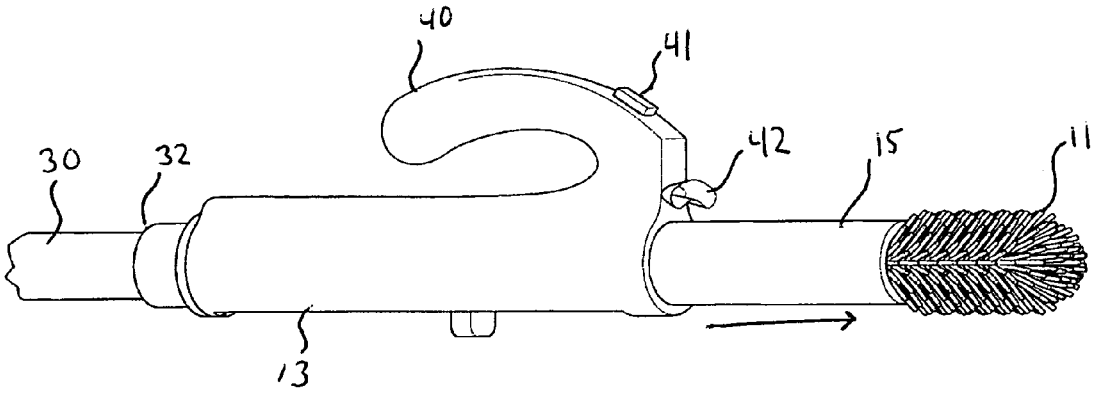
FIG. 3 is a perspective view of the duster brush assembly with the duster brush cleaning hollow tubular member partially extended to cover part of the duster brush.
Figure 4:
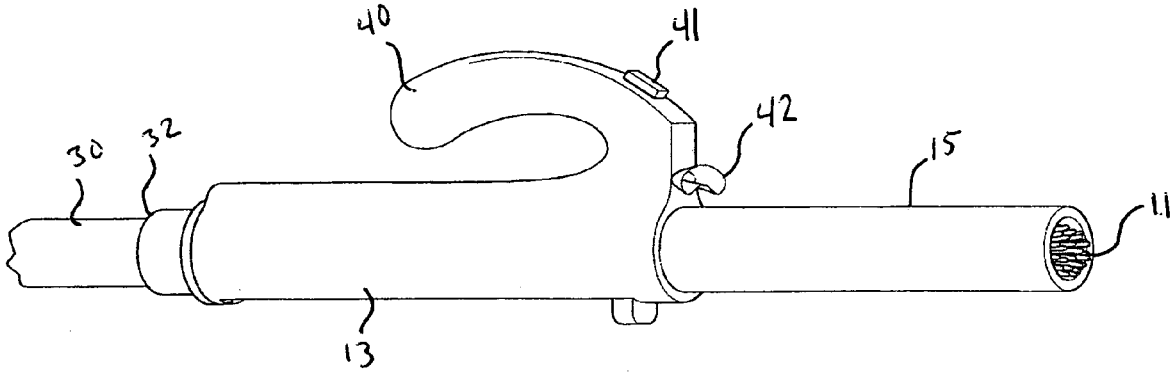
FIG. 4 is a perspective view of the duster brush assembly with the duster brush cleaning hollow tubular member fully extended to cover all of the duster brush, in this fully extended position of the duster brush cleaning hollow tubular member the duster brush can be cleaned.
Figure 5:
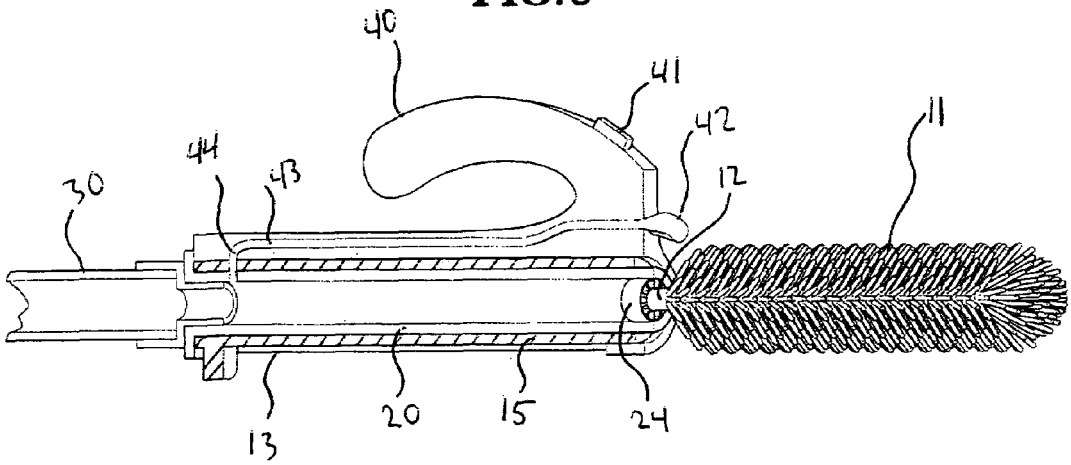
FIG. 5 is a sectional view of FIG. 2.
Figure 6:
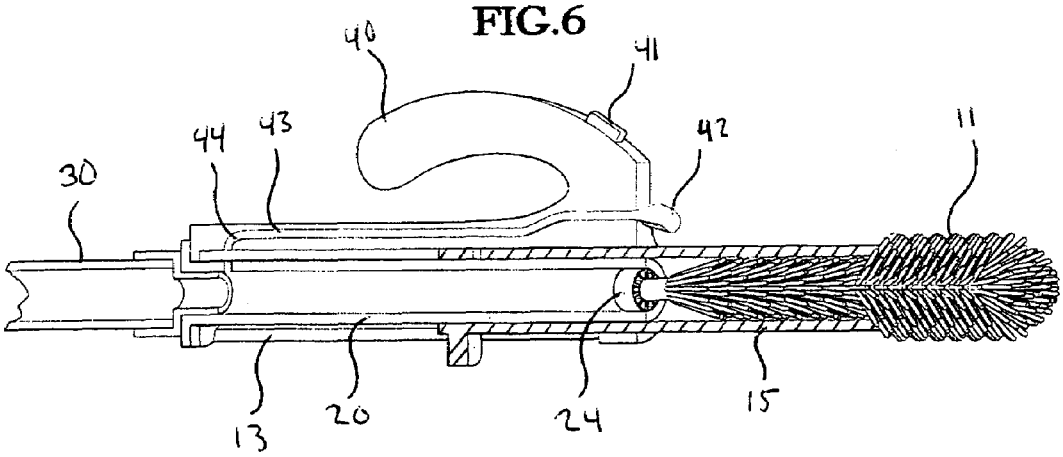
FIG. 6 is a sectional view of FIG. 3.
Figure 9:
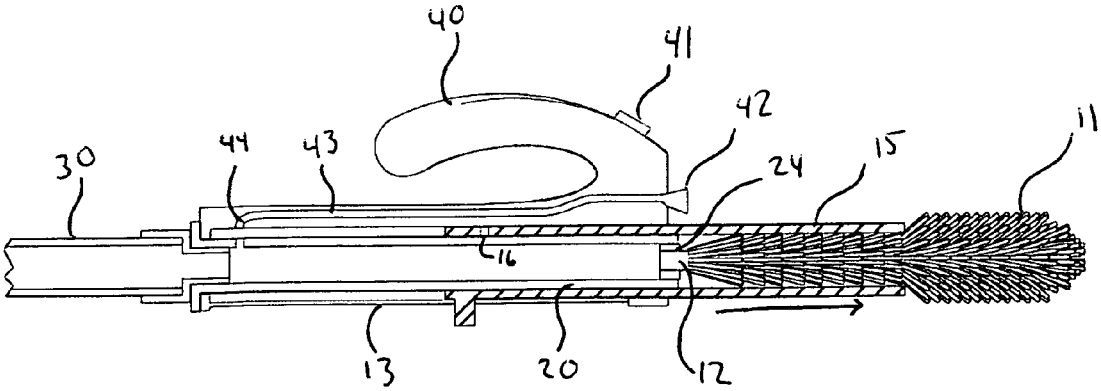
FIG. 9 is a side sectional view of FIG. 3.
Figure 10:
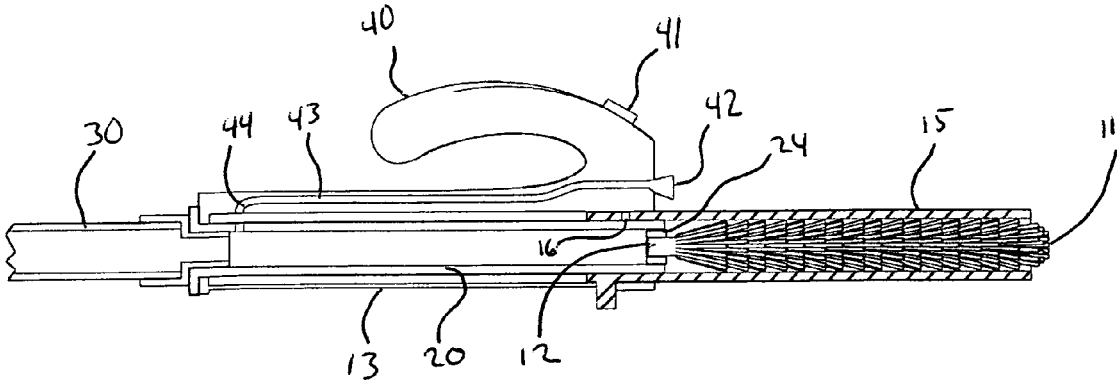
FIG. 10 is a side sectional view of FIG. 4.
Figure 11:
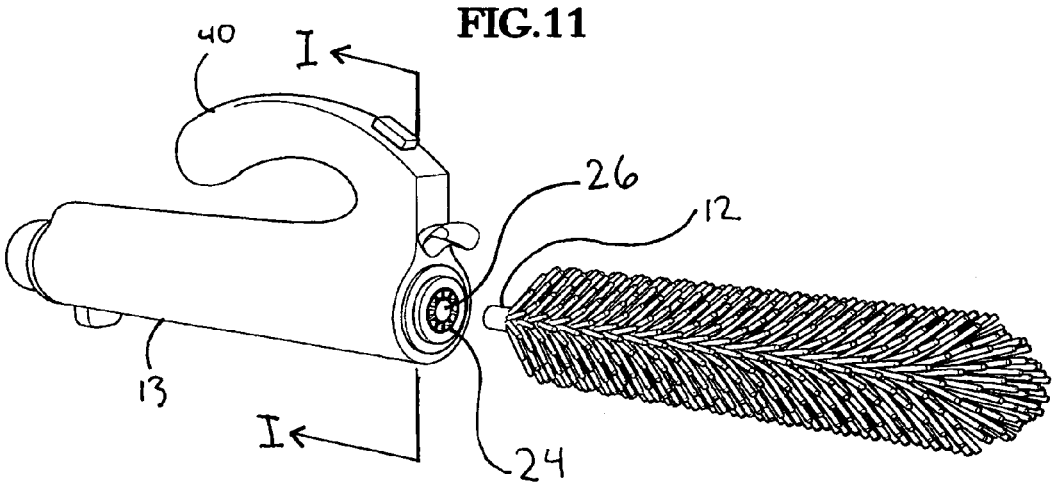
FIG. 11 is an enlarged front perspective view of the duster brush assembly with the duster brush removed therefrom.
Figure 12:
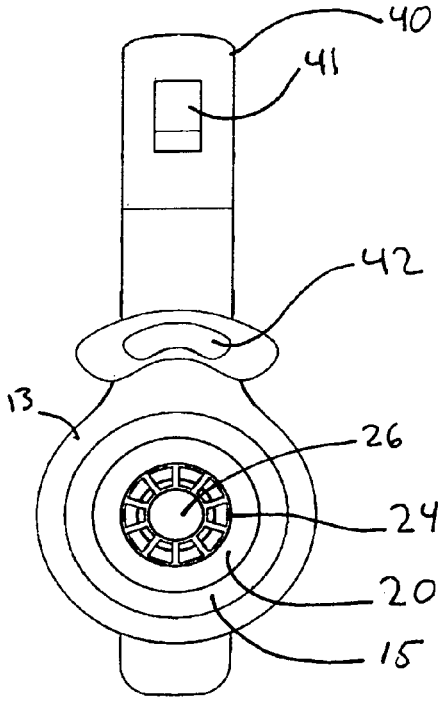
FIG. 12 is an enlarged front cross sectional view taken along line I-I of FIG. 11.

Duster brush cleaning tube 15 has a greater diameter than suction tube 20 and slides over suction tube 20. When duster brush cleaning tube 15 is pushed rearward duster brush 11 extends completely outside of duster brush cleaning tube 15, as illustrated in FIGS. 1, 2, 5, and 8. When duster brush cleaning tube 20 is pushed forward duster brush 11 is encompassed within and surrounded by duster brush cleaning tube 11, as illustrated in FIGS. 4 and 10. When duster brush cleaning tube 15 is moved only partially rearward or forward over vacuum tube 20, it is in the position shown in FIGS. 3,6 and 9 with the duster brush 11 partially within duster brush cleaning tube 11 and partially outside of duster brush cleaning tube 11.

Duster brush cleaning tube 15 fits tightly over suction tube 20 and is held in place against movement by friction. It can, however, be moved by pulling or pushing by hand. The fit of duster brush cleaning tube 15 over inner suction tube 20 is tight enough to maintain the suction provided by the vacuum cleaner within duster brush cleaning tube 15. This fit may be achieved by a pressure fit or other means such as a rubber seal such as rubber gasket.

Figure 7:
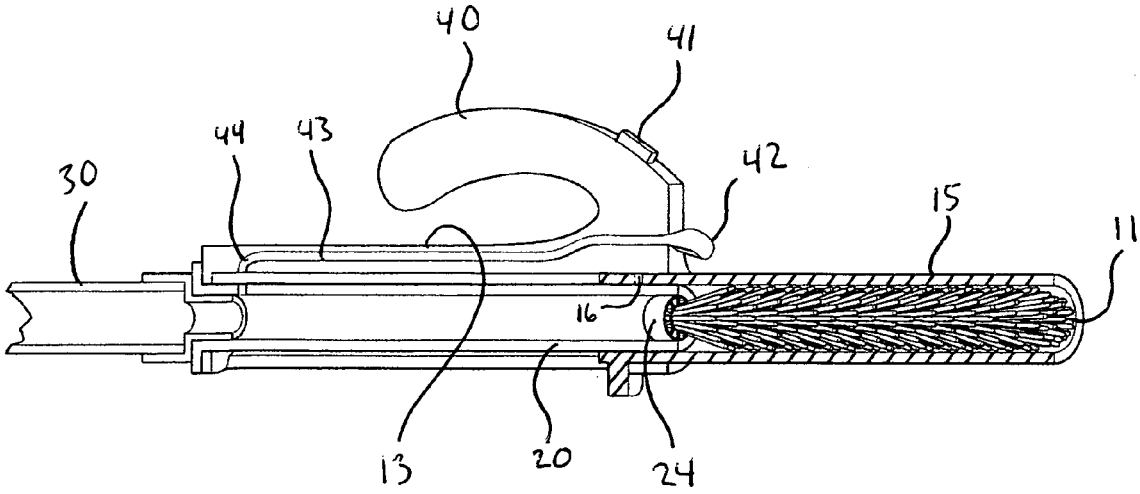
FIG. 7 is a sectional view of FIG. 4.

With the duster brush 11 fully encompassed within duster brush cleaning tube 15, as illustrated in FIGS. 4, 7 and 10, the suction provided by the vacuum cleaner 40 sucks out all of the dust and debris present in the duster brush 11 and thereby cleans duster brush 11.

The duster brush assembly is held and carried by handle 40 at the top of casing 13. An on-off button is located in the front top of handle 40.

Figure 8:
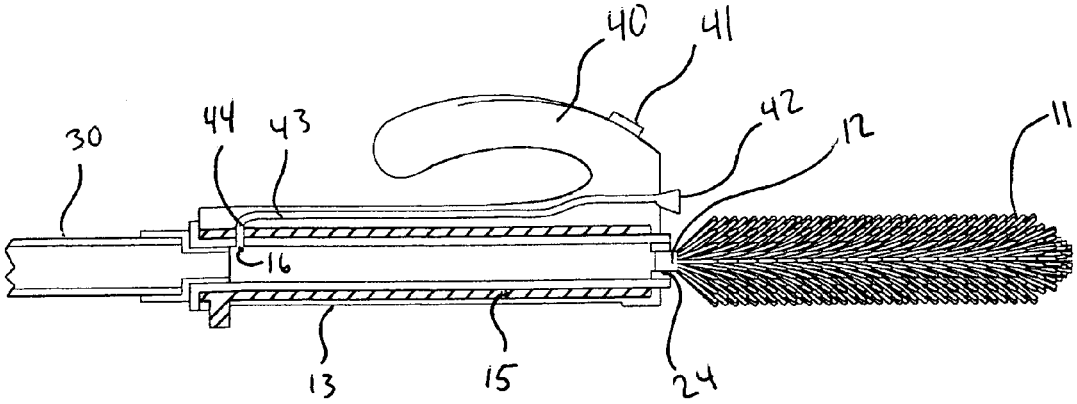
FIG. 8 is a side sectional view of FIG. 2.

Located in the front of handle 40, above duster brush 11, is auxiliary vacuum opening 42 which communicates via distal end 44 of small tube 43 with suction tube 20. This communication occurs only when distal end 44 is aligned with port 16 disposed in the top of vacuum cleaning tube 20, as best seen in FIG. 8. When small tube 43 is in communication with suction tube 20, suction is provided to auxiliary vacuum opening 42 and some dust and particles of debris are sucked from the duster brush 11 and into the vacuum cleaner during the dusting process. As can be seen from the figures, particularly FIGS. 7-8, the distal and 44 of small tube 43 is aligned with port 16 only when the duster brush 11 is in the entirely uncovered or clear position as illustrated in FIGS. 1, 2, 5 and 8. It is in this position that one dusts and cleans and needs the suction provided by auxiliary vacuum opening 42. It is to be understood that auxiliary vacuum opening may be opened and closed by other means including, but not limited to, a mechanical valve operated by the action of opening and closing the vacuum cleaner.

The present invention may be embodied in other specific forms without departing from its spirit or essential characteristics. The described embodiments are to be considered as illustrative only and not limiting.

What is claimed is:

1. A vacuum cleaner comprising a vacuum cleaner, a duster brush assembly, and a flexible hose connecting said vacuum cleaner to said duster brush assembly; said duster brush assembly comprising:

1) a duster brush:

2) an inner suction tube in which said duster brush is mounted; and 3) an outer duster brush cleaning tube telescopically mounted on said suction tube, said duster brush cleaning tube adapted to slide over and encompass said duster brush; said inner suction tube being in communication with said vacuum cleaner at one end thereof via said flexible hose and having a vacuum therein when said vacuum cleaner is on; and said outer duster brush cleaning tube being in communication with said inner suction tube and having a vacuum therein when said vacuum cleaner is on.

2. The vacuum cleaner of claim 1 wherein said duster brush assembly comprises an outer casing encompassing said inner suction tube and said outer duster brush cleaning tube.

3. The vacuum cleaner of claim 2 wherein said outer casing comprises an auxiliary vacuum opening in its front adjacent said duster brush which aspirates dust and dirt from said duster brush during dusting.

4. The vacuum cleaner of claim 1 wherein said vacuum cleaner is a portable vacuum cleaner.

5. The vacuum cleaner of claim 4 wherein said portable vacuum cleaner is a shoulder carried portable vacuum cleaner.

6. A duster brush assembly for vacuum cleaners comprising:

1) a duster brush:

2) an outer casing comprising an auxiliary vacuum opening in its front adjacent said duster brush which sucks in dust and dirt from said duster brush during dusting;

3) an inner suction tube disposed in said outer casing in which said duster brush is mounted; and 4) an outer duster brush cleaning tube in said outer casing telescopically mounted on said suction tube, said duster brush cleaning tube sliding over and encompassing said duster brush to clean said duster brush when it is moved telescopically forward over said inner suction tube.

* * * * *